US011083360B2

(12) United States Patent
Narayana Pillai et al.

(10) Patent No.: US 11,083,360 B2
(45) Date of Patent: Aug. 10, 2021

(54) APPLIANCE WITH LIGHT GUIDE

(71) Applicant: Whirlpool Corporation, Benton Harbor, MI (US)

(72) Inventors: Ajay Ram Narayana Pillai, Saint Joseph, MI (US); Ameresh B. Viswanathan, Saint Joseph, MI (US); Jonathan D. Pugh, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 118 days.

(21) Appl. No.: 16/395,501

(22) Filed: Apr. 26, 2019

(65) Prior Publication Data

US 2020/0337523 A1 Oct. 29, 2020

(51) Int. Cl.
*A47L 15/42* (2006.01)

(52) U.S. Cl.
CPC ..... *A47L 15/4293* (2013.01); *A47L 15/4257* (2013.01)

(58) Field of Classification Search
CPC ..... A47L 15/4293
See application file for complete search history.

(56) References Cited

U.S. PATENT DOCUMENTS

| | | | | |
|---|---|---|---|---|
| 8,870,392 | B2 | 10/2014 | Kleinert et al. | |
| 10,004,376 | B2 | 6/2018 | Cottrell et al. | |
| 2010/0147738 | A1 | 6/2010 | Green | |
| 2016/0095493 | A1* | 4/2016 | Gary, Jr. ..... | A47L 15/0063 134/57 DL |
| 2017/0187091 | A1 | 6/2017 | Acker et al. | |

FOREIGN PATENT DOCUMENTS

| | | | |
|---|---|---|---|
| DE | 102004019329 | A1 | 11/2005 |
| EP | 2700346 | A2 | 2/2014 |

* cited by examiner

*Primary Examiner* — Jason Y Ko
(74) *Attorney, Agent, or Firm* — McGarry Bair PC

(57) ABSTRACT

An appliance, such as a dishwasher, can include a tub at least partially defining a treating chamber with an access opening, a closure moveable relative to the access opening to selectively open and close the access opening and having at least one exterior surface, and a light source located within the closure. The appliance can also include a controller communicatively coupled to the light source, and an antenna communicatively coupled to the controller.

19 Claims, 9 Drawing Sheets

420

APPLIANCE WITH LIGHT GUIDE

BACKGROUND

Contemporary automatic dishwashers for use in a typical household include a tub, at least one rack or basket for supporting soiled dishes within the tub, and a door for opening and closing the tub. Dishwashers can also include elements to indicate a status of operation. Such status indicators are typically located on a user interface located on a front side of the door or along the top edge of the door.

BRIEF DESCRIPTION

In one aspect, the disclosure relates to a dishwasher for treating dishes according to an automatic cycle of operation. The dishwasher includes a tub at least partially defining a treating chamber with an access opening, a closure moveable relative to the access opening to selectively open and close the access opening and having at least one exterior surface, a light source located within the closure, a controller communicatively coupled to the light source and configured to indicate a status of operation of the dishwasher via the light source, a light guide connecting the light source to the at least one exterior surface of the closure and defining a guide surface, and an antenna secured to the guide surface and communicatively coupled to the controller.

In another aspect, the disclosure relates to an appliance for treating articles according to an automatic cycle of operation. The appliance includes a tub at least partially defining a treating chamber with an access opening, a closure moveable relative to the access opening to selectively open and close the access opening and having at least one exterior surface, a light source located within the closure, a controller communicatively coupled to the light source and configured to indicate a status of operation of the appliance via the light source, a light guide connecting the light source to the at least one exterior surface of the closure and defining a guide surface, and an antenna secured to the guide surface and communicatively coupled to the controller.

In yet another aspect, the disclosure relates to a method of indicating an operating status of a dishwasher. The method includes determining, via a controller within the dishwasher, an operating status of the dishwasher, generating light via a light source in signal communication with the controller in accordance with the operating status, directing, via a light guide connected to the light source and a closure of the dishwasher, the generated light from the light source to at least one exterior surface of the closure to indicate the operating status, and transmitting, via an antenna coupled to a surface of the light guide, the operating status to a receiver.

DETAILED DESCRIPTION

Aspects of the disclosure generally relate to a closure for an appliance having a status indicator. More specifically, aspects relate to a door with a user interface and the indicator being remote from the user interface along a side edge of the door.

Aspects will be described herein in the context of an automatic dishwasher, and it will be understood that the disclosure is not so limited and may have general applicability in other environments, such as other household or commercial appliances.

Figure 1:
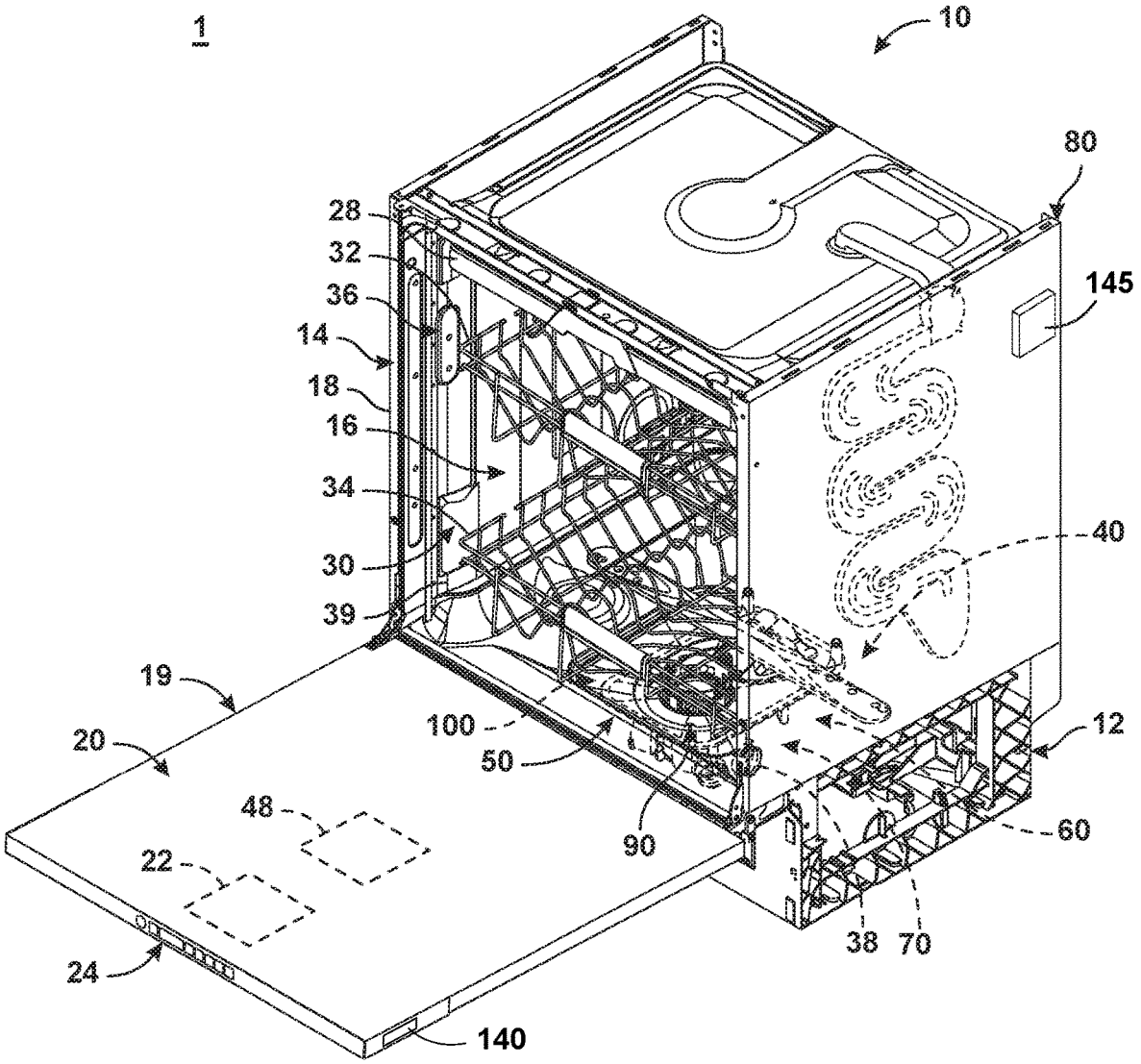
FIG. 1 is a right-side perspective view of an appliance in the form of an automatic dishwasher having multiple systems for implementing an automatic cycle of operation.

FIG. 1 illustrates an appliance 1 configured to implement an automatic cycle of operation to treat articles received within the appliance 1. In the illustrated example, the appliance 1 is illustrated in the form of an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, as well as to any other appliance configured to treat articles, such as a clothes washer, dryer, or steamer, in non-limiting examples.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an open face 18, for receiving the dishes. A closure 19 in the form of a door assembly 20 can be pivotally mounted to the base 12 for movement between opened and closed positions to selectively open and close the open face 18 of the tub 14. Additionally or alternatively, the door assembly 20 can be slidably mounted to the base 12, such as in a drawer-type implementation. Thus, the door assembly 20 provides selective accessibility to the treating chamber 16 for the loading and unloading of dishes or other items.

The door assembly 20 can include at least one indicator 140. The indicator 140 can be configured to indicate a status of operation of the dishwasher 10. In non-limiting examples, the indicator 140 can include a light source, a transparent portion connected to a light source, a sound source, or a mechanical indicator such as a pop-up switch.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure 19 being a part of the chassis or the countertop of the surrounding cabinetry. In a sink-type implementation, the sink forms the tub and the cover closing the open top of the sink forms the closure 19. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information. The controller 22 can also be operably coupled with the indicator 140 and configured to indicate a status of operation of the dishwasher 10 via the indicator 140.

In addition, a wireless receiver 145 can be located within the dishwasher 10. In the illustrated example, the wireless receiver 145 is located on an external surface of the tub 14, exteriorly of the treating chamber 16. In an example where the dishwasher 10 includes an outer cabinet surrounding the tub 14, the wireless receiver can be located within the outer cabinet. The wireless receiver 145 can be communicatively coupled to the controller 22 and can be configured to transmit signals to, or receive signals from, the controller 22 or an additional source such as an antenna or a mobile device.

The dish holding system 30 can include any suitable structure for holding dishes within the treating chamber 16. Exemplary dish holders are illustrated in the form of an upper dish rack 32 and a lower dish rack 34, commonly referred to as "racks", which are located within the treating chamber 16. The upper dish rack 32 and lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and still have the third level rack 28 slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
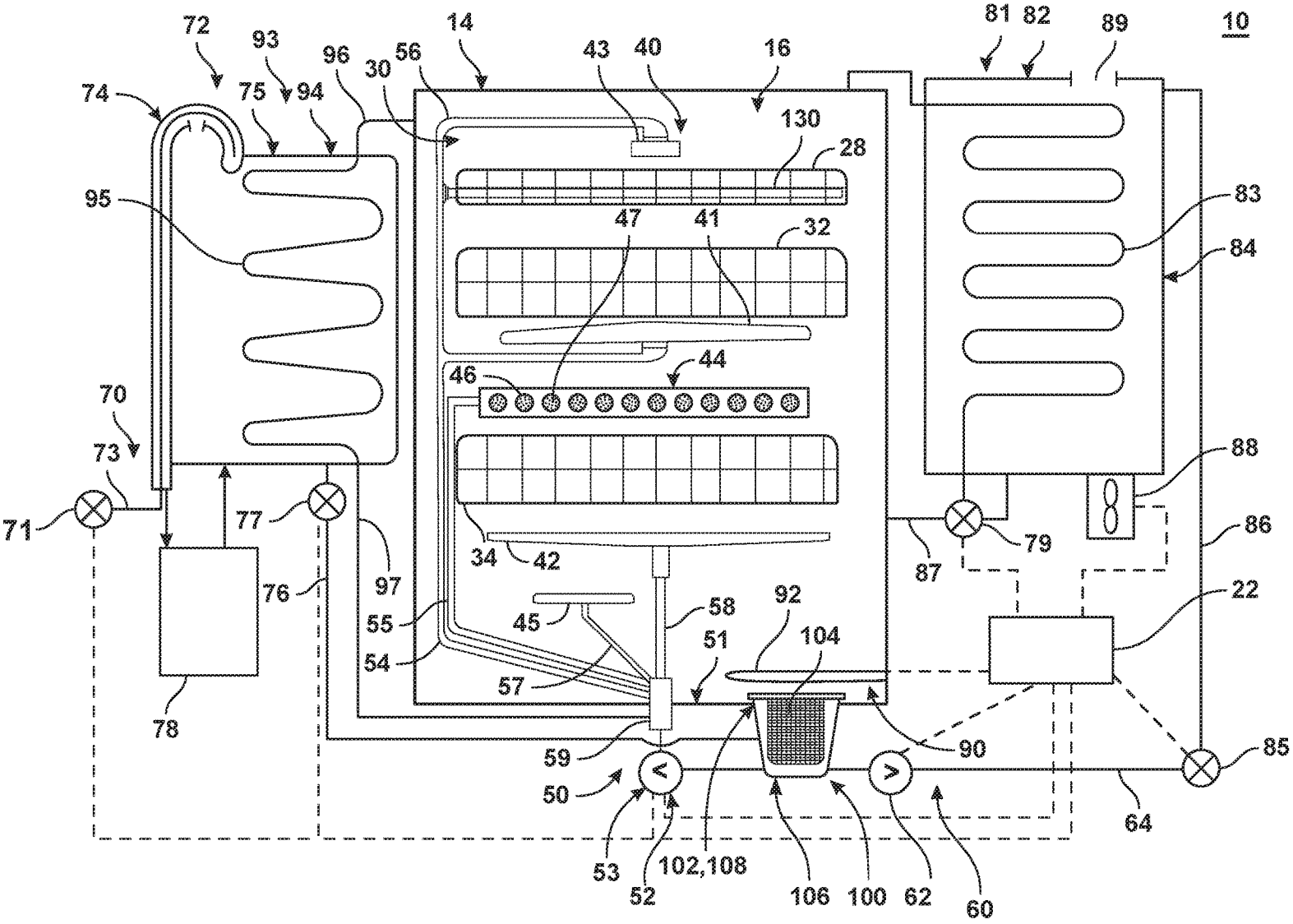
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include an upper spray arm 41, a lower spray arm 42, a third level sprayer 43, a deep-clean sprayer 44, and a spot sprayer 45. The six sprayers 41, 42, 43, 44, 45, 46 are illustrative examples of suitable sprayers and are not meant to be limiting as to the type of suitable sprayers.

The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 can be fixed or movable, such as by rotating. In addition to or in place of the third level sprayer 43, another sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46 with multiple apertures 47 generating an intensified and/or higher pressure spray than the upper spray arm 41, the lower spray arm 42, or the third level sprayer 43. The nozzles 46 can be fixed or movable, such as by rotating. The spray emitted by the deep-clean sprayer 44 defines a deep clean zone which is illustrated along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprise multiple units and/or extend along multiple portions, including different walls, of the tub 14, and can be provided above, below or beside any of the dish holders when deep-cleaning is desired.

The spot sprayer 45 can also emit an intensified and/or higher pressure spray similar to the deep-clean sprayer 44, such as to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can also be fixed or movable, such as by rotating.

The recirculation system 50 recirculates the liquid sprayed by the spray system 40 into the treating chamber 16 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps, and is illustrated with a recirculation pump 53. The sump 51 can also be a separate module that is affixed to the bottom wall and include the pump assembly 52.

Multiple supply conduits 54, 55, 56, 57, 58 fluidly couple the sprayers 41-45 to the recirculation pump 53. A recirculation valve 59 can selectively fluidly couple each of the conduits 54-58 to the recirculation pump 53. While each sprayer 41-45 is illustrated as having a corresponding dedicated supply conduit 54-58, one or more subsets comprising multiple sprayers from the total group of sprayers 41-45 can be supplied by the same conduit, negating the need for a dedicated conduit for each sprayer. For example, a single conduit can supply the upper spray arm 41 and the third level sprayer 43. Another example is that the sprayer 130 is supplied with liquid by the conduit 56, which also supplies the third level sprayer 43.

The recirculation valve 59, while illustrated as a single valve, can be implemented with multiple valves. Additionally, one or more of the supply conduits 54-58 can be directly coupled to the recirculation pump 53, while one or more of the other supply conduits 54-58 can be selectively coupled to the recirculation pump 53 with one or more valves. There are essentially an unlimited number of plumbing schemes to connect the recirculation system 50 to the spray system 40. The illustrated plumbing is not limiting.

A drain system 60 forms a drain circuit to drain liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a cooling supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, cooling supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can also use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
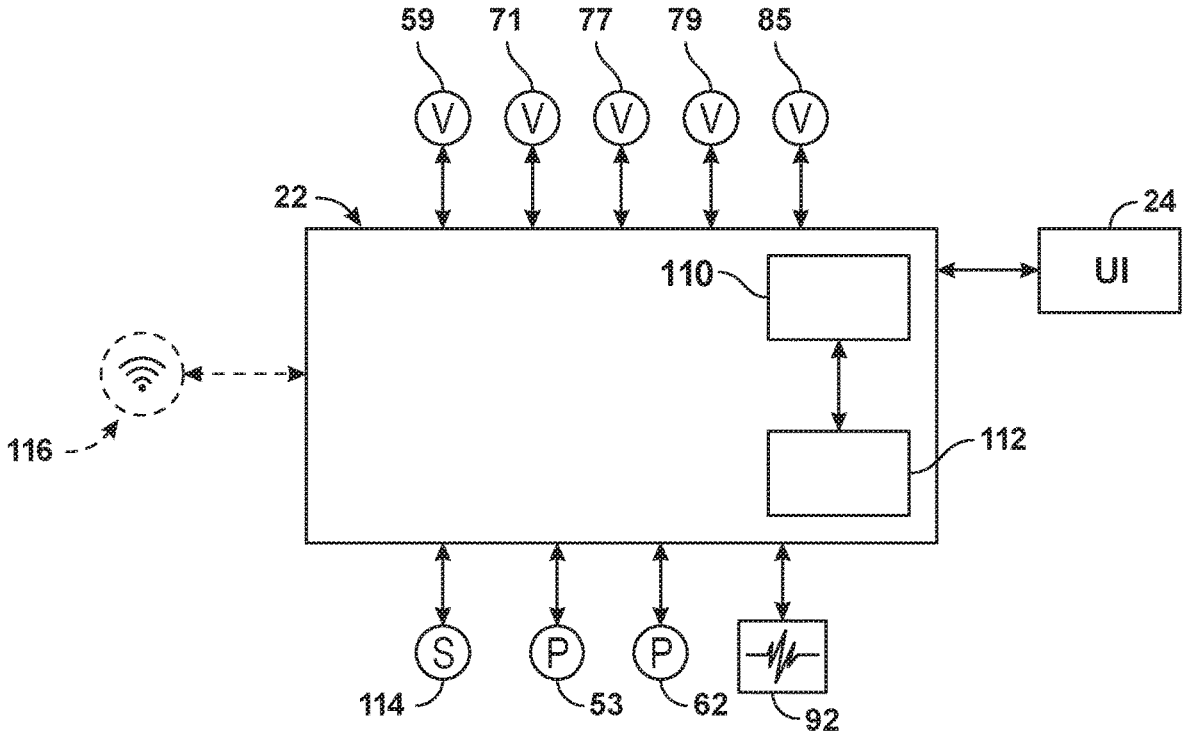
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, household water valve 71, controllable valve 77, return valve 79, and the valve 85. Optionally, the controller 22 can include or communicate with a wireless communication device 116.

Figure 4:
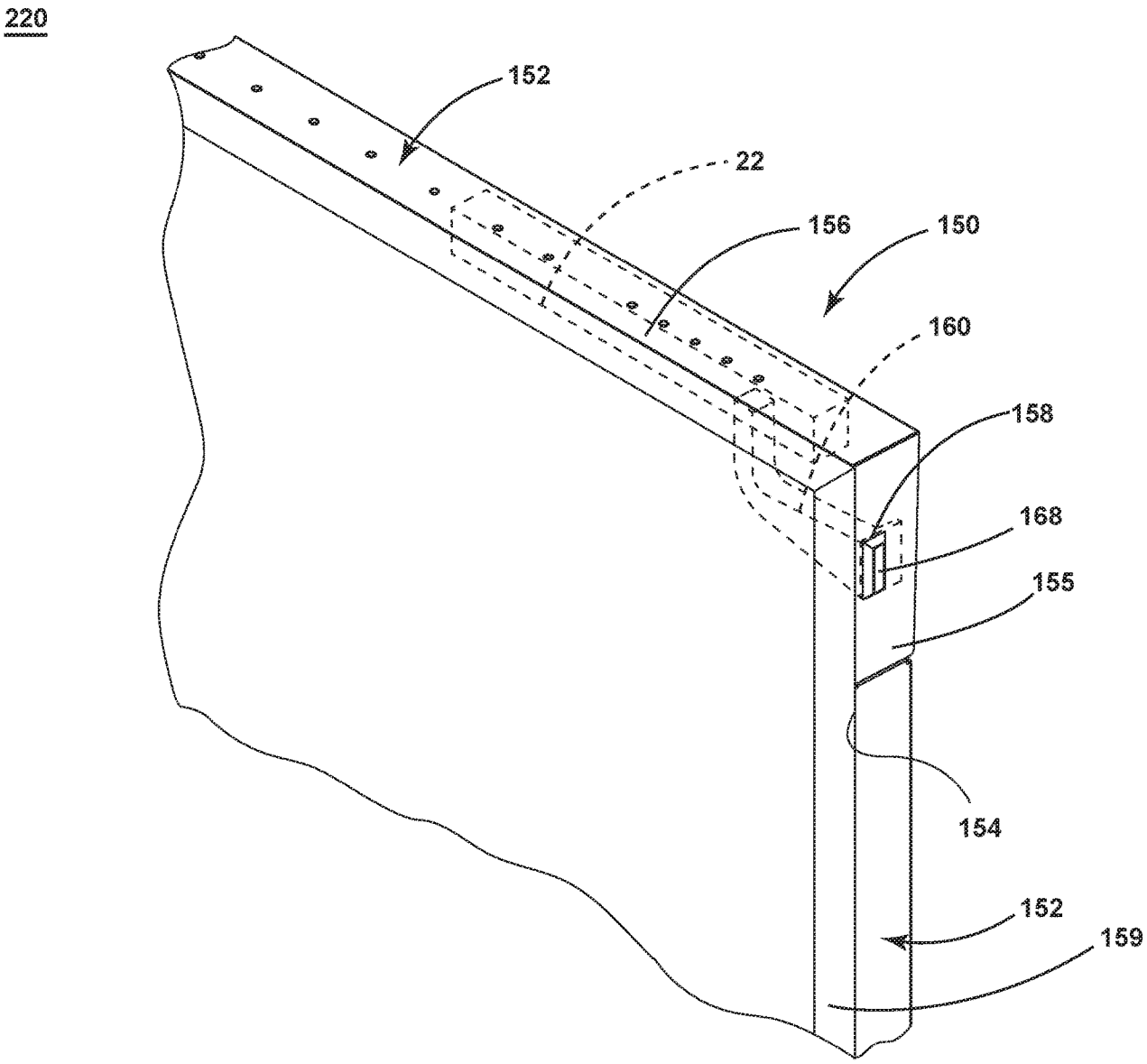
FIG. 4 is a perspective view of a closure that can be utilized in the automatic dishwasher of FIG. 1 in the form of a door assembly having a light guide according to various aspects described herein.

Turning to FIG. 4, a portion of the door assembly 20 is illustrated. The door assembly 20 is illustrated as including a door 150 with at least one exterior surface 152. More specifically, the door 150 can include a front exterior surface 154, at least one side exterior surface 155, and a top exterior surface 156. In the example shown, a cover or panel 159 is provided on the front exterior surface 154 of the door 150. Alternately, the door assembly 20 can include the door 150 with no such panel or cover.

In the illustrated example, the indicator 140 is in the form of a light guide 160 extending through an aperture 158 in the door 150 and terminating in a guide end 168. The aperture 158 is shown on the side exterior surface 155 of the door 150. In other examples, multiple indicators 140 including multiple light guides 160 can be provided on the top exterior surface 156, side exterior surface 155, front exterior surface 154, or a combination thereof. In yet another example, the light guide 160 can be configured to project through the aperture 158 without extending through the aperture 158.

In addition, while the guide end 168 is illustrated as essentially rectangular with beveled corners, any geometric profile can be utilized. For example, the guide end 168 can be circular, oval, or rectangular with rounded corners, in non-limiting examples.

Figure 5:
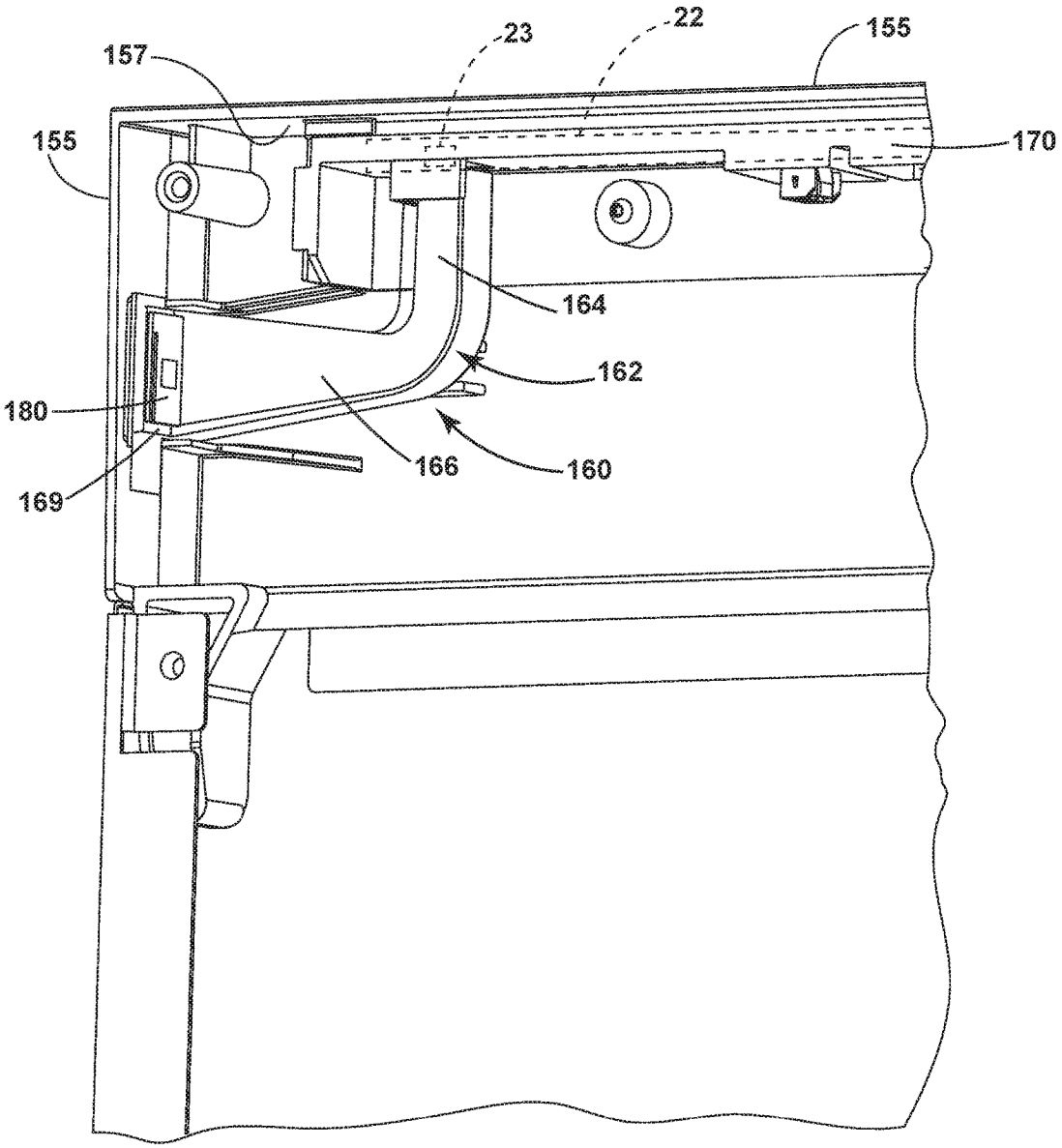
FIG. 5 is a rear perspective view of the door assembly of FIG. 4, with a rear panel removed to show the interior of the door and illustrating the light guide of FIG. 4 in combination with an antenna.

FIG. 5 illustrates the interior of the door assembly 20. The controller 22 can be mounted to an inner surface 157 of the door 150, such as via a mounting plate 170. It is contemplated that the controller 22 can be included on a larger circuit board located within the interior of the door, such as a printed circuit board (PCB) containing other electronic components such as additional processors, memory, or other logic circuits not shown.

At least one light source 23 can be provided on the PCB. The light source 23 can be in the form of a light-emitting diode (LED), including multiple LEDs. The controller 22 can be communicatively coupled to the light source 23 and indicate a status of operation of the dishwasher 10 via the light source 23. For example, the LEDs can be steadily illuminated, blink, flash, or gradually brighten or dim to indicate such a status. In other examples, the LEDs can change color, form a graphical icon such as an 'X,' "check mark," or the like, or display a numerical output such as an elapsed time of operation.

The light guide 160 connects the light source 23 to the side exterior surface 155 of the door 150. In the example shown, the light guide 160 has an L-shaped body 162 with a first leg 164 connected to the light source 23 and a second leg 166 connected to the 166 exterior surface 155 at the aperture 158, where the guide end 168 is provided on the second leg 166. The light guide 160 can be made of a transparent material such as glass, acrylic, plexiglass, film, fiber optic cable, or any transparent injection-molded plastic, in non-limiting examples. While shown as L-shaped, the body 162 can have any suitable geometric profile including U-shaped, J-shaped, S-shaped, or an asymmetric or irregular profile, in non-limiting examples. Light can travel within the body 162 via internal reflections such that the light emitted by the light source 23 can be directed to the aperture 158 without "leaking" out the sides of the light guide 160 to the interior of the door 150.

The light guide 160 can also include a guide surface 169 spaced from the side exterior surface 155 as shown. In the illustrated example the guide surface 169 is adjacent the aperture 158 and abuts the wall forming the side exterior surface 155. An antenna 180 can be secured to the guide surface 169. In one example the antenna 180 can be coupled to the guide surface 169 via mounting hardware or adhesive. In another example, the antenna 180 can be integrated with the guide surface 169 or encapsulated within the light guide 160, such as by injection molding the guide surface 169 to at least partially encapsulate the antenna 180.

In one example, the antenna 180 can be in the form of a passive antenna including passive electronic components such as metal rods, capacitors, inductors, or the like. In another example, the antenna 180 can be in the form of an active antenna having active electronic components, such as an amplifier (not shown) that can be coupled to a power supply (not shown). The antenna 180 can be communicatively coupled to the controller 22; for example, the controller 22 can transmit or receive signals from the antenna 180. In addition, the antenna 180 can be in signal communication with the wireless receiver 145 (FIG. 1). In such a case, the antenna 180 can serve as a signal repeater wherein the antenna 180 is configured to receive a wireless signal, amplify the received signal to define an amplified signal, and to transmit the amplified signal to the wireless receiver 145.

Figure 6:
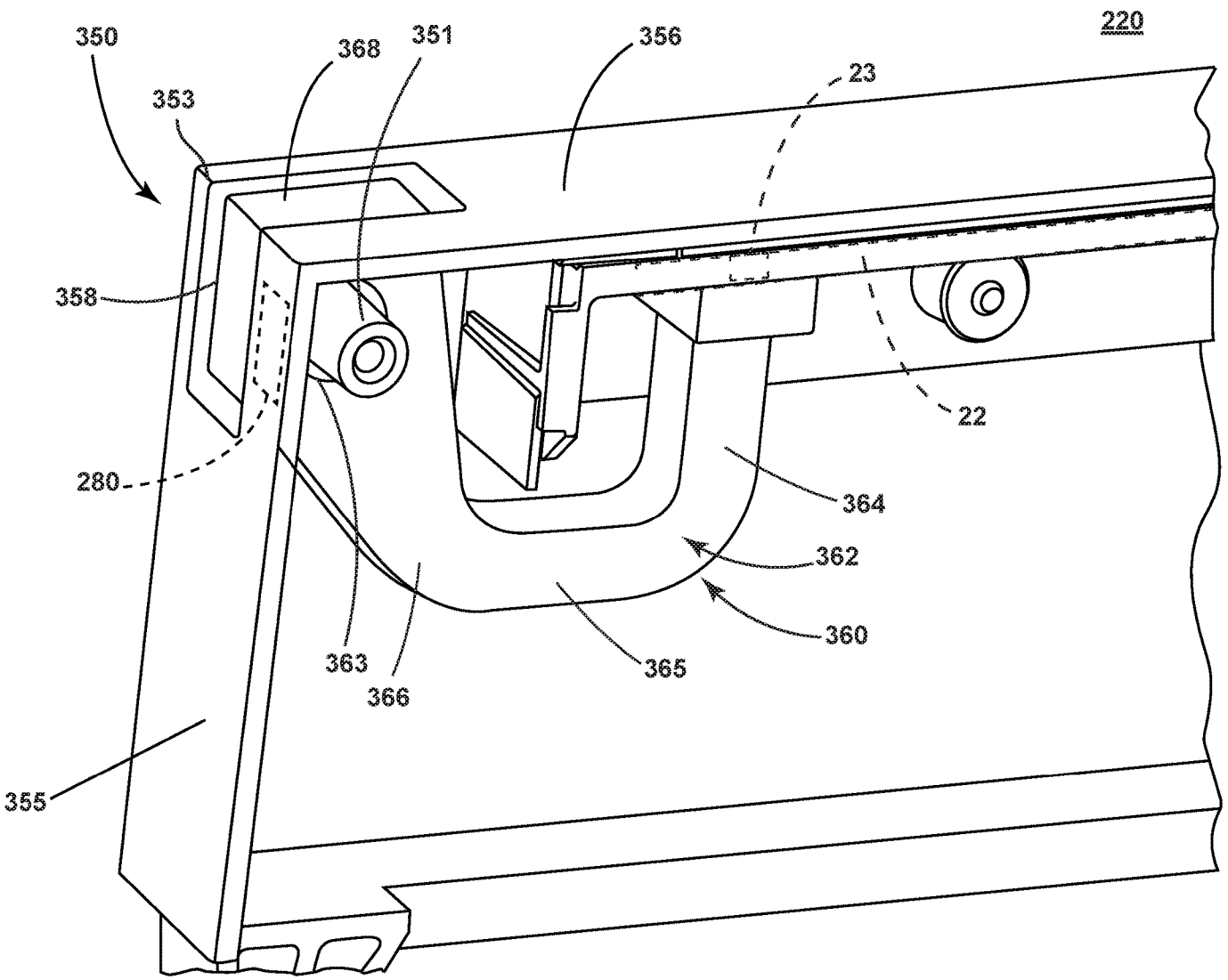
FIG. 6 is a rear perspective view of another door assembly and light guide that can be utilized in the automatic dishwasher of FIG. 1 according to various aspects described herein.

Turning to FIG. 6, another door assembly 220 is illustrated that can be utilized in the dishwasher 10 of FIG. 1. The door assembly 220 is similar to the door assembly 20; therefore, like parts will be indicated with like numerals increased by 200, with it being understood that the description of the like parts of the door assembly 20 applies to the door assembly 220, except where noted.

The door assembly 220 includes a door 350 having a side exterior surface 355 and top exterior surface 356. The controller 22 and the light source 23 are provided within the door 350. A light guide 360 couples the light source 23 to an aperture 358. One difference is that the aperture 358 has a generally rectangular surface profile and extends in an L-shape over a corner 353 that joins the side and top exterior surfaces 355, 356. Another difference is that the light guide 360 has a generally U-shaped body 362. In the example shown, a first leg 364 of the body 362 couples to the light source 23, a second leg 366 extends toward the corner 353, and the first and second legs 364, 366 are joined by a web 365. The second leg 366 includes an L-shaped guide end 368 that can extend through the aperture 358. Optionally, the light guide 360 can include a through-hole 363 to accommodate a mounting post 351 or other feature within the door 350. In the illustrated example, the through-hole 363 is provided in the second leg 366. In such a case, light can transmit through the interior of the light guide 360 around the through-hole 363 toward the guide end 368.

In addition, an antenna 280 can be provided on the light guide 360, such as on an inner-facing guide surface (not shown) similar to that shown in FIG. 5. The antenna 280 can be an active antenna or passive antenna, and can be encapsulated within the light guide or attached via a mechanical coupling such as a snap-fit connection, adhesive, or other suitable coupling.

Figure 7:
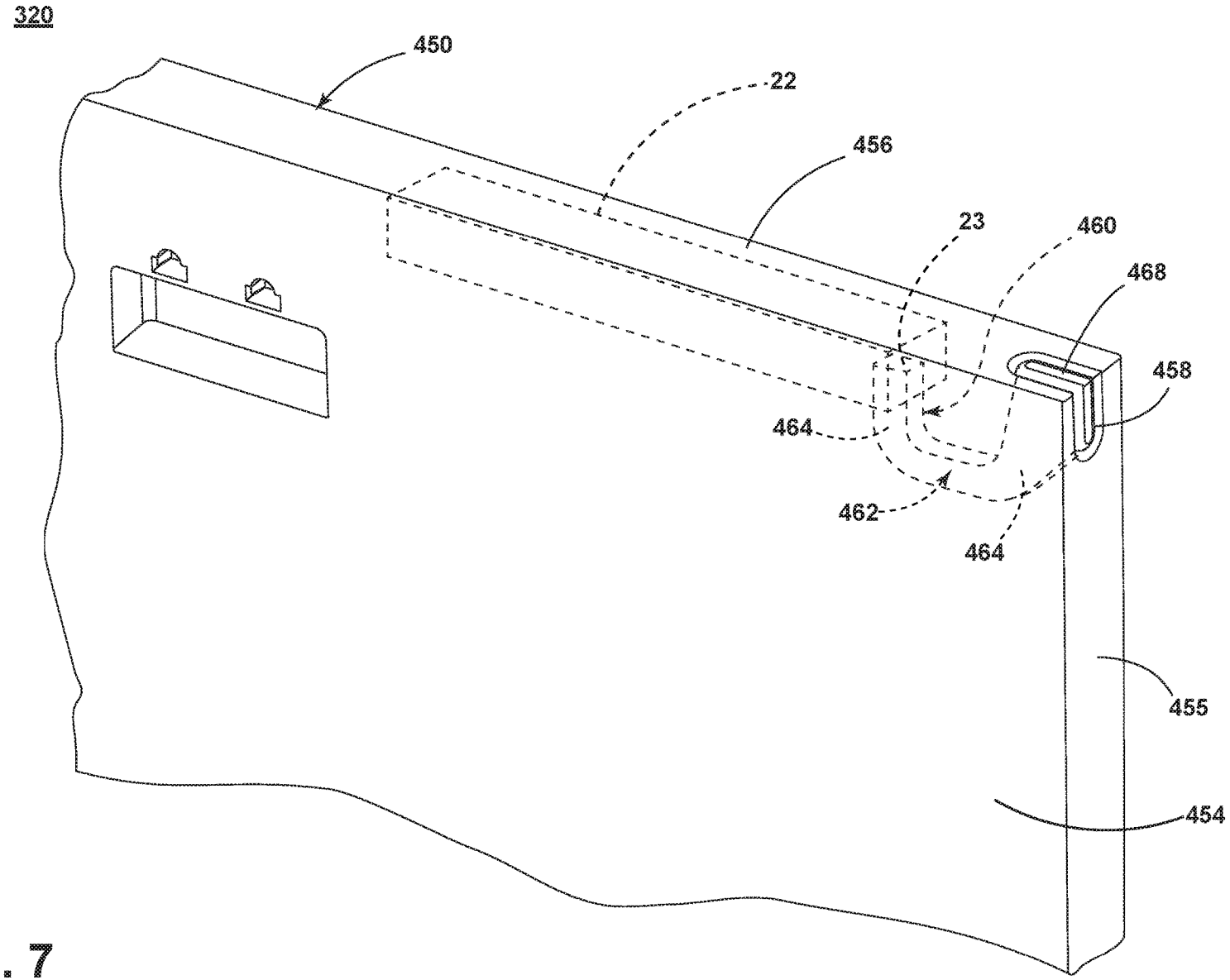
FIG. 7 is a front perspective view of yet another door assembly and light guide that can be utilized in the automatic dishwasher of FIG. 1 according to various aspects described herein.

Referring now to FIG. 7, another door assembly 320 is illustrated that can be utilized in the dishwasher 10 of FIG. 1. The door assembly 320 is similar to the door assembly 20, 220; therefore, like parts will be indicated with like numerals further increased by 100, with it being understood that the description of the like parts of the door assembly 20, 220 applies to the door assembly 320, except where noted.

The door assembly 320 includes a door 450 having a front exterior surface 454, side exterior surface 455, and top exterior surface 456. The controller 22 and the light source 23 are provided within the door 450. A light guide 460 is coupled to the light source 23. The light guide 460 can have a generally U-shaped body 462 with a guide end 468. An aperture 458 can be provided in the door 450 extending in an L-shape over a corner 453 that joins the side and top exterior surfaces 455, 456. The guide end 468 can extend to, or through, the aperture 458. One difference is that the aperture 458 can have a rounded surface profile on the top exterior surface 456 and side exterior surface 455. The guide end 468 can have a similarly rounded profile to match that of the aperture 458. Other non-limiting examples of geometric or surface profiles for the aperture 458 include oval, square with rounded corners, or irregular or asymmetric profiles.

Figure 8:
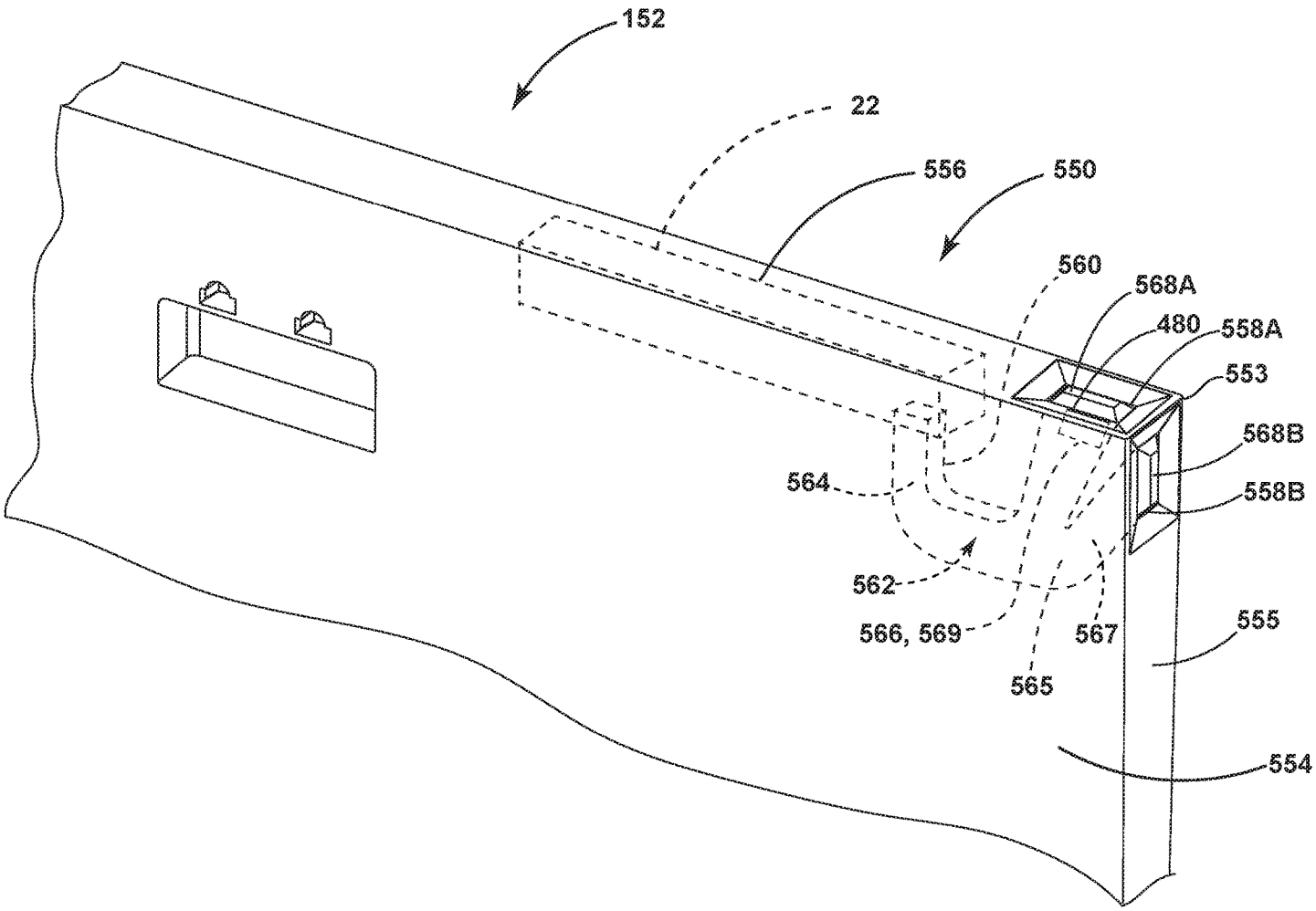
FIG. 8 is a front perspective view of still another door assembly and light guide that can be utilized in the automatic dishwasher of FIG. 1 according to various aspects described herein.

Turning to FIG. 8, another door assembly 420 is illustrated that can be utilized in the dishwasher 10 of FIG. 1. The door assembly 420 is similar to the door assembly 20, 220, 320; therefore, like parts will be indicated with like numerals further increased by 100, with it being understood that the description of the like parts of the door assembly 20, 220, 320 applies to the door assembly 420, except where noted.

The door assembly 420 includes a door 550 having a front exterior surface 554, side exterior surface 555, and top exterior surface 556. The controller 22 and the light source 23 are provided within the door 550. A light guide 560 is coupled to the light source 23.

One difference is that multiple apertures can be provided in the door 550. In the illustrated example, a first aperture 558A is provided in the top exterior surface 556 near the corner 553, and a second aperture 558B is provided in the side exterior surface 555 near the corner 553. Another difference is that the light guide 560 can include a generally Y-shaped body 562 with a first leg 564, a second leg 566, and a third leg 567 joined at a junction 565. First and second guide ends 568A, 568B can be defined at the respective second and third legs 566, 567. The first leg 564 can couple to the light source 23, and the guide ends 568A, 568B can extend to, or through, the respective apertures 558A, 558B. While the apertures 558A, 558B are illustrated as rectangular, any profile can be utilized including square, round, oval, rectangular with rounded edges, or asymmetric or irregular, in non-limiting examples.

Another difference is that an antenna 480 can be coupled to a side surface of the light guide 560. In the example shown, the antenna 480 is coupled to the side of the second leg 566 which forms a guide surface 569. A top portion or strip of the antenna 480 can be visible within the first aperture 558A adjacent the first guide end 568A as shown. It is also contemplated that the antenna can extend along an entire length of the first aperture 558A. In another example, the guide surface 569 can be defined around the entire second leg 566 such that the antenna extends around a perimeter of the first aperture 558A. Additionally or alternatively, multiple antennae can be provided, such as an antenna coupled to each of the first and second guide ends 568A, 568B.

In another example (not shown), the light guide can include a single leg extending to multiple apertures in the door. In such a case, the single leg can include a guide end sufficiently large to cover over the multiple apertures, and can extend to be flush or coplanar with the multiple apertures without extending therethrough. It can be appreciated that such a light guide can be formed with a simplified geometry without need of forming multiple branches to correspond with multiple apertures.

In yet another example (not shown), the light guide can include multiple first legs coupled to corresponding multiple light sources. In such a case, a first light source can transmit light toward a first aperture, and a second light source can transmit light toward a second aperture. The multiple first and second legs can be separated or joined by at least one junction.

In any example described above, the light guide can include at least one first leg coupled to the light source, and at least one second leg coupled to at least one exterior surface of the door. A single second leg can couple to a single aperture or multiple apertures, or multiple second legs can couple to corresponding multiple apertures. An antenna can be coupled to any suitable surface of the light guide in any example described above, either by encapsulation or integral formation with the light guide, or by a mechanical coupling to the light guide such as a snap-fit connection, adhesive, or other suitable coupling.

Figure 9:
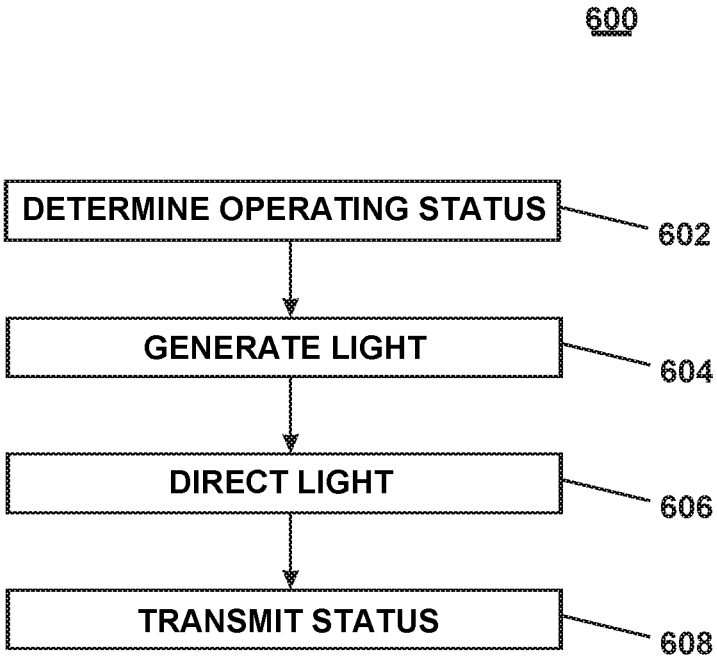
FIG. 9 is a flowchart illustrated a method of indicating an operating status of the dishwasher of FIG. 1.

FIG. 9 illustrates a method 600 of indicating an operating status of the dishwasher 10. During operation of the dishwasher 10, the controller 22 can determine at 602 an operating status such as "ready," "idle," "washing," "rinsing," "drying," or the like. The operating status can include other state parameters such as an elapsed time of the overall cycle, an elapsed time of the current stage of the overall cycle, or a time remaining until the overall cycle is completed, in non-limiting examples. The controller 22 can generate light at 604 by signaling the light source 23 to illuminate in accordance with the operating status. Optionally, the generating light can include blinking, flashing, steadily illuminating, illuminating in sequence, animating, changing a color, or forming an icon image via the light source 23. At 606, the light guide 160, 360, 460, 560 can direct the generated light from the light source 23 to at least one exterior surface of the door 150, 350, 450, 550 to indicate the operating status. For example, the light guide 160, 360, 460, 560 can direct the light to the guide end 168, 368, 468, 568 extending to or through the aperture 158, 358, 458, 558A, 558B. Optionally, light can be projected out the guide end 168, 368, 468, 568 toward an adjacent surface to the dishwasher 10, such as a cabinet surface or floor. At 608, the operating status can be transmitted via the antenna 180, 280, 480 to a receiver. The antenna 180, 280, 480 can transmit the operating status to any suitable receiver, such as the wireless receiver 145, a mobile device (not shown) or a second appliance (not shown), in non-limiting examples. The antenna can also be configured to amplify a received wireless signal to define an amplified signal, and to transmit the amplified signal to the wireless receiver 145, thereby functioning as a signal repeater for the wireless receiver 145 as described above.

It can be appreciated that positioning the antenna toward the front of the appliance, as can improve signal communication with the antenna and reduce electromagnetic shielding effects as compared with traditional antenna mounting locations near the rear of the appliance, such as at the rear of the tub. The use of an antenna within the door assembly as a signal repeater for a second wireless receiver can improve signal communication with the wireless receiver, such as for retrofitting current appliances with receivers mounted near the rear. In addition, securing or integrating the antenna with the light guide can reduce installation complexity and improve process efficiencies compared to other solutions such as forming a dedicated aperture in the door to house the antenna.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to an automatic cycle of operation, comprising:

a tub at least partially defining a treating chamber with an access opening;

a closure moveable relative to the access opening to selectively open and close the access opening and having at least one exterior surface, wherein the at least one exterior surface includes at least one aperture;

a light source located within the closure;

a controller communicatively coupled to the light source and configured to indicate a status of operation of the dishwasher via the light source;

a light guide connecting the light source to the at least one exterior surface of the closure and defining a guide surface; and an antenna secured to the guide surface and communicatively coupled to the controller.

2. The dishwasher of claim 1 wherein the closure is pivotally attached to the dishwasher.

3. The dishwasher of claim 1 wherein the guide surface is spaced from the at least one exterior surface of the closure.

4. The dishwasher of claim 1 wherein the light guide comprises a body with a first leg coupled to the light source and at least one second leg coupled to the at least one aperture.

5. The dishwasher of claim 1 wherein the at least one exterior surface comprises at least one of a side exterior surface or a top exterior surface of the closure.

6. The dishwasher of claim 1 further comprising a wireless receiver in signal communication with the antenna.

7. The dishwasher of claim 6 wherein the wireless receiver is secured to the tub exteriorly of the treating chamber.

8. The dishwasher of claim 7 wherein the antenna is configured to amplify a received wireless signal to define an amplified signal.

9. The dishwasher of claim 8 wherein the antenna is further configured to transmit the amplified signal to the wireless receiver.

10. The dishwasher of claim 1 wherein the antenna comprises a passive antenna.

11. The dishwasher of claim 1 wherein the antenna is encapsulated within the light guide.

12. The dishwasher of claim 1 wherein the light source comprises at least one light-emitting diode.

13. An appliance for treating articles according to an automatic cycle of operation, comprising:

a tub at least partially defining a treating chamber with an access opening;

a closure moveable relative to the access opening to selectively open and close the access opening and having at least one exterior surface, wherein the at least one exterior surface includes at least one aperture;

a light source located within the closure;

a controller communicatively coupled to the light source and configured to indicate a status of operation of the appliance via the light source;

a light guide connecting the light source to the at least one exterior surface of the closure and defining a guide surface; and an antenna secured to the guide surface and communicatively coupled to the controller.

14. A method of indicating an operating status of the dishwasher of claim 1, comprising:

determining, via a controller within the dishwasher, an operating status of the dishwasher;

generating light via a light source in signal communication with the controller in accordance with the operating status;

directing, via a light guide connected to the light source and a closure of the dishwasher, the generated light from the light source to at least one exterior surface of the closure to indicate the operating status; and transmitting, via an antenna coupled to a surface of the light guide, the operating status to a receiver.

15. The method of claim 14 wherein the receiver is coupled to a tub within the dishwasher.

16. The method of claim 14 wherein the generating further comprises at least one of blinking, steadily illuminating, illuminating in sequence, animating, changing a color, or forming an icon image via the light source.

17. The method of claim 14 further comprising projecting the generating light from the at least one exterior surface of the closure to an adjacent surface of a component external to the dishwasher.

18. The method of claim 17 wherein the adjacent surface comprises at least one of a floor or a cabinet surface.

19. The method of claim 14 wherein the at least one exterior surface comprises a side exterior surface of the closure.

* * * * *